United States Patent [19]

Canda

[11] 4,266,301

[45] May 12, 1981

[54] CHEMICAL-BIOLOGICAL AGENT PROTECTIVE HOOD

[75] Inventor: William R. Canda, Custer County, Colo.

[73] Assignee: The United States of America as represented by the Secretary of the Air Force, Washington, D.C.

[21] Appl. No.: 100,578

[22] Filed: Dec. 5, 1979

[51] Int. Cl.[3] ..... A42B 3/00; A42B 3/02

[52] U.S. Cl. ..... 2/410; 2/6; 2/171.3

[58] Field of Search ..... 2/6, 410, 171.3, 2.1 A, 2/4, 5, 7, 422–425, 9, 46, 50, 103, 129, 130; 179/156 R, 156 A

[56] References Cited

U.S. PATENT DOCUMENTS

| | | | |
|---|---|---|---|
| 2,579,942 | 12/1951 | MacLean | 2/410 X |
| 2,583,304 | 1/1952 | Pipher | 2/410 X |
| 2,978,708 | 4/1961 | Williams et al. | 2/410 |
| 3,075,200 | 1/1963 | Crouzet | 2/410 |
| 3,128,469 | 4/1964 | Lobelle | 2/6 |
| 3,943,571 | 3/1976 | Boatman | 2/6 X |
| 4,035,845 | 7/1977 | Hochwalt | 2/6 |
| 4,035,846 | 7/1977 | Jencks | 2/6 X |
| 4,091,469 | 5/1978 | Davidson | 2/410 |
| 4,095,289 | 6/1978 | Kissen et al. | 2/171.3 X |

*Primary Examiner*—Louis Rimrodt

*Attorney, Agent, or Firm*—Donald J. Singer; Richard J. Killoren

[57] ABSTRACT

A protective hood for protecting flight crewmembers from chemical-biological agents having a nonpermeable covering which fits over the helmet and extends over the shoulders of the flight suit. A rigid transparent lens is sealed to the helmet covering and is positioned in front of the flight helmet visor assembly. A hose enclosure member is secured to the helmet covering and is closed around the oxygen hose with hook and loop fasteners. Hook and loop fasteners also provide a closure for the front of the helmet covering and shoulder covering members. Openings, sealed with pocket members are provided on the side of the protective hood to permit adjustment of the visor. An air nozzle is provided under the hood to provide flushing of chemical-biological agents as well as cooling and evaporative action in the facial region.

6 Claims, 8 Drawing Figures

CHEMICAL-BIOLOGICAL AGENT PROTECTIVE HOOD

RIGHTS OF THE GOVERNMENT

The invention described herein may be manufactured and used by or for the Government of the United States for all governmental purposes without the payment of any royalty.

BACKGROUND OF THE INVENTION

This invention relates to a protective hood to be worn with flight crew helmet and visor assembly.

The patent to Hockwalt, U.S. Pat. No. 4,035,845, shows a helmet where the cover is made of parts which have been sewn together. The patents to Lobelle, U.S. Pat. No. 3,128,469 and Kissen et al, U.S. Pat. No. 4,095,289, describe helmets with ventilating systems.

For chemical-biological agent protection, more extensive protection is needed than that provided by ventilating helmets. This must be accomplished with minimal degradation in the crewmember performance and comfort.

BRIEF SUMMARY OF THE INVENTION

According to this invention a protective hood is provided, for air flight crewmembers, which can be worn with standard flight equipment. The hood is made of an impermeable material which fits down over the flight helmet and has a polycarbonate lens covering the face portion of the hood. The lens fits down around the face mask and is contoured and spaced from the face of the flight crewmember to permit normal attachment of the dual visor assembly to the helmet. Pockets are provided in the side of the hood to permit normal operation of the dual visor assembly.

IN THE DRAWINGS

DETAILED DESCRIPTION OF THE INVENTION

Figure 1:
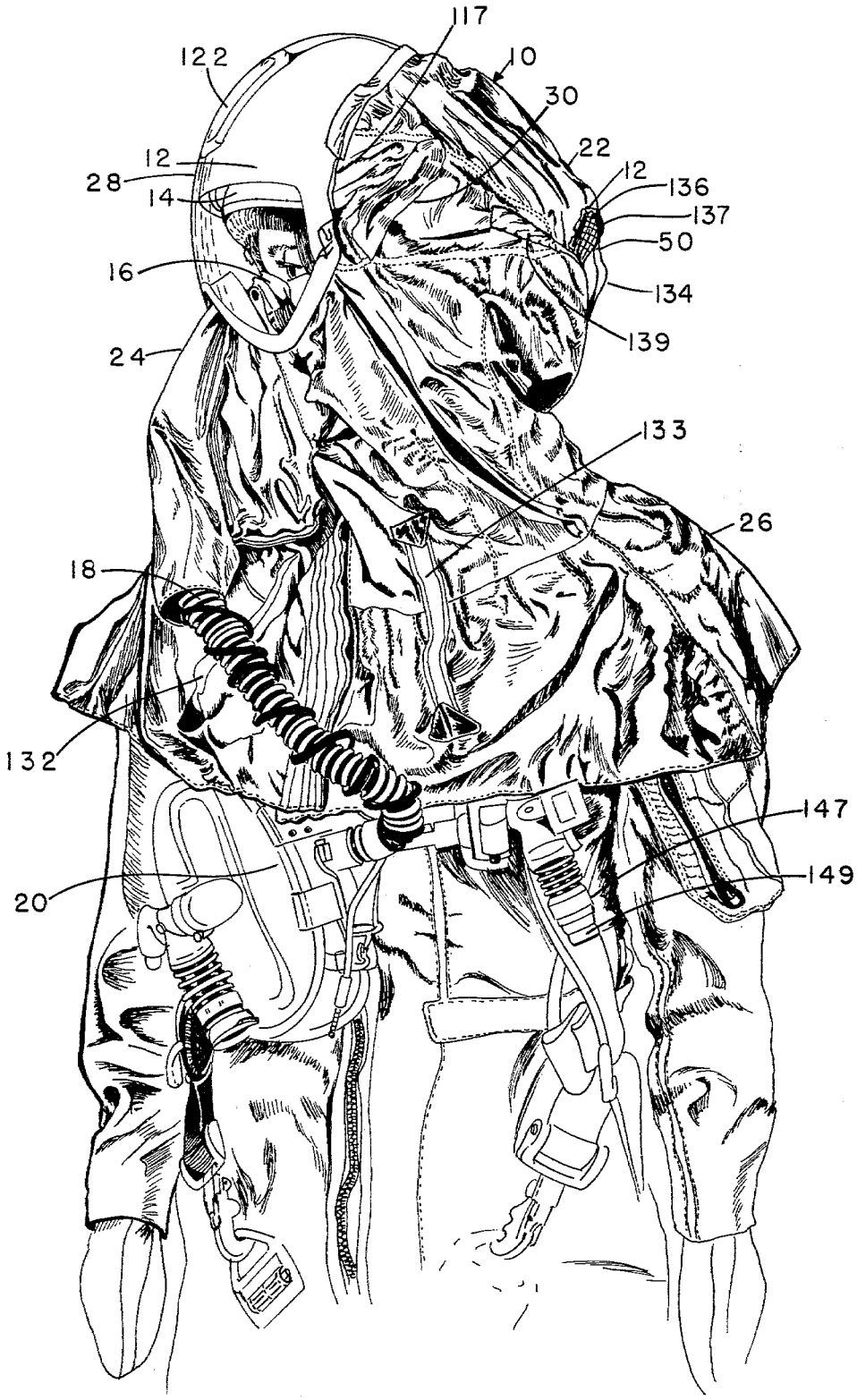
FIG. 1 is a partially schematic isometric view of a protective hood according to the invention.

Reference is now made to FIG. 1 of the drawing which shows a protective hood 10 to be worn over a flight helmet 12. The flight helmet 12 has a visor assembly 14 and an oxygen mask 16 attached to it in a conventional manner. An oxygen hose 18 is connected between the oxygen mask 16 and a chemical-biological filter 20.

The protective hood includes a helmet covering member 22, a hose enclosure member 24, a shoulder covering member 26 and a rigid transparent lens 28. Openings 30, one of which is shown in FIG. 1, are provided in the member 22 to permit adjustment of the visor assembly 14. The members 22, 24 and 26 are made of a material nonpermeable to chemical-biological agent vapors, for example a coated fabric such as butyl-coated nylon or butyl-coated Kevlar. The lens 28 may be made of a polycarbonate.

Figure 2:
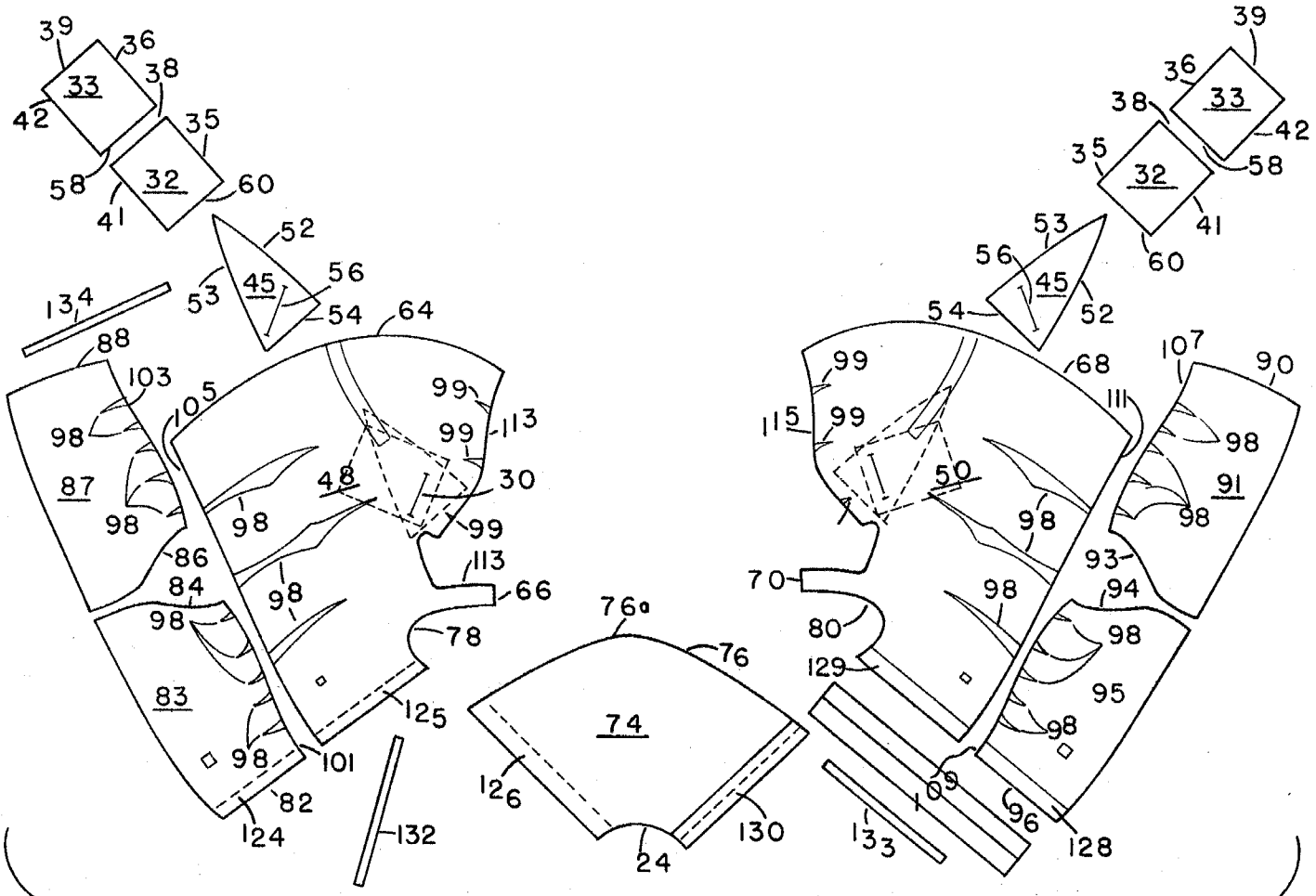
FIG. 2 is a plan view of the members used in the device of FIG. 1.
Figure 3:
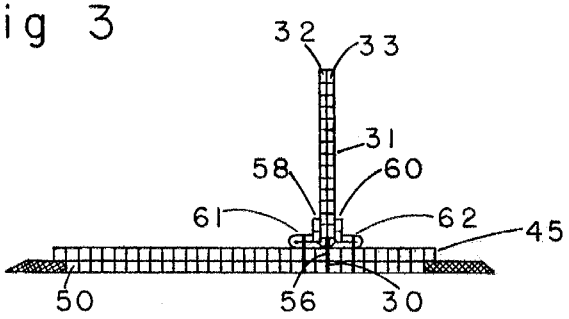
FIG. 3 is a schematic end view showing the pocket members used in the device of FIG. 1.

Pocket members 31, not shown in FIG. 1, are provided internally of the hood. The pocket members 31, one of which is shown in FIG. 3, are made by attaching members 32, shown in FIG. 2, to member 33 by sewing, adjacent the edges 35 and 36, by sewing adjacent the edges 38 and 39 and by sewing adjacent the edges 41 and 42. Reinforcement members 45 are secured to the members 48 and 50 by sewing adjacent the edges 52, 53 and 54 with slits 56 aligned with slits 30 in members 48 and 50. The pockets are secured to members 45, 58 and 50 by folding edges 58 and 60 back, as shown in FIG. 3, and sewing the double layer, as shown schematically at 61 and 62, to members 45, 48 and 50 along opposite sides of slits 56 and 30. The members 32, 33 and 45 are made of the same nonpermeable material as the members 22, 24 and 26.

The helmet covering member 22 is made by attaching member 48 to member 50 by sewing along edges 64 and 66 of member 48 and edges 68 and 70 of member 50. The hose enclosure member 24 is secured to the helmet covering member 22 by sewing the member 74 to members 48 and 50 along edge 76 of member 74 and along edges 78 and 80 of members 48 and 50. Some gathering of the material of member 74 is provided in the region 76*a*.

Figure 4:
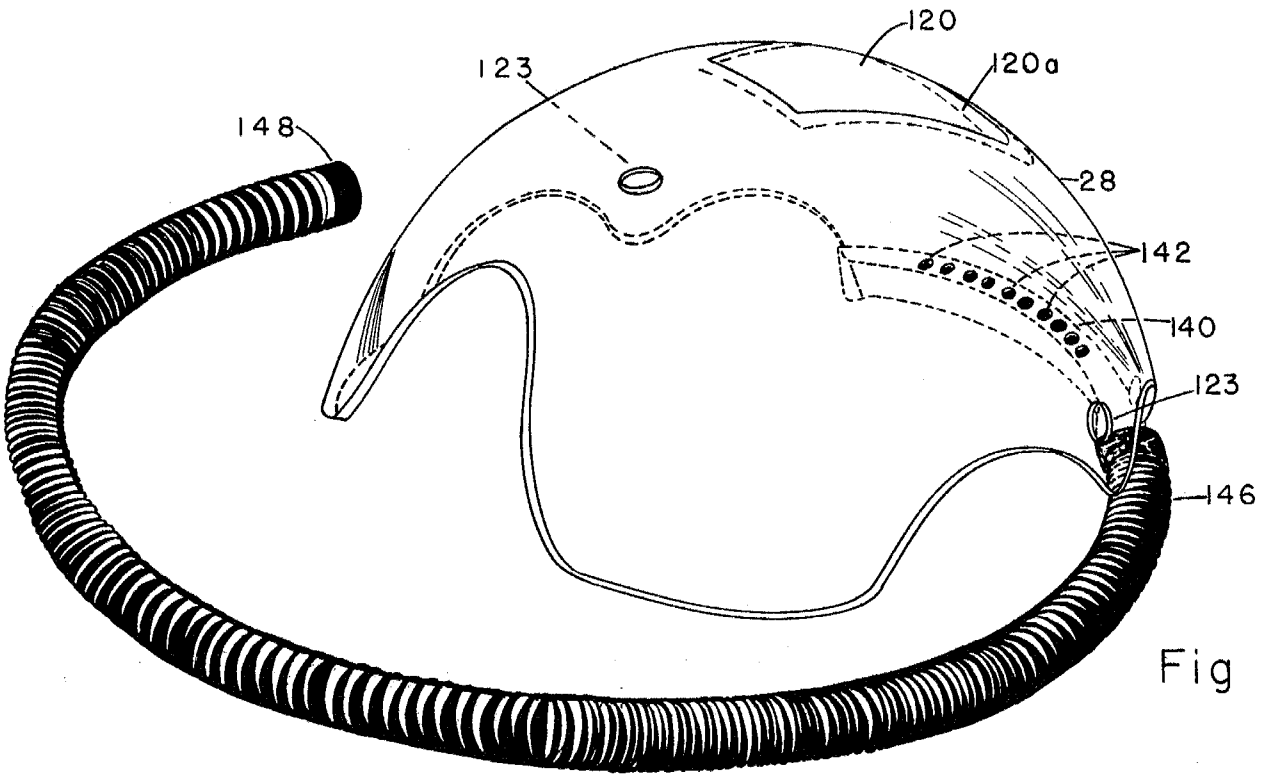
FIG. 4 is an isometric view of the lens member and air flow hose and nozzle used in the device of FIG. 1.

The shoulder enclosure skirt member 26 is made by sewing member 83 to member 87 along edge 84 of member 83 and along edge 86 of member 87; by sewing member 87 to member 91 along edge 88 of member 87 and along edge 90 of member 91 and by sewing member 91 to member 95 along edge 93 of member 91 and along edge 94 of member 95. Gores 98 are provided in members 48, 50, 83, 87, 91 and 95, by sewing the material. Gores 98 are also provided in members 48 and 50. The member 26 is secured to member 22 by sewing members 83 and 87 to member 48 along the edges 101 and 103 of members 83 and 87 and along edge 105 of member 48 and by sewing members 91 and 95 to member 50 along edges 107 and 109 of members 91 and 95 and along edge 111 of member 50. The lens member 28, shown in greater detail in FIG. 4, is secured to members 48 and 50 along edge 113 of member 48 and edge 115 of member 50. A rubber cement is used to secure the lens member 28 to members 48 and 50. The members 48 and 50 are secured to the outer surface lens member 50 along the entire edge except a region 117, shown in FIG. 1, on opposite sides of the hood. In this region the members 48 and 50 are drawn over the edge of the lens members 28 and secured to the under side of the lens. This provides an area of attachment for flash blindness goggles, not shown, which fit over the hood. An opening 120 in the lens member 28 allows access to the flash blindness goggle top latch connector member 122. A closed cell foam rubber seal 120*a* is provided around the opening 120 on lens member 28. Holes 123 are provided in the lens member 28 to accommodate the top visor track screws and permit a flush fit of the lens to the visor housing. The bottom of the lens is cut out to accommodate the oxygen mask and is cut high enough to allow the crewmember to perform the valsalva maneuver.

Hook and loop fastener material, such as Velcro fasteners, are used to secure member 48 to member 50, the end 82 of member 83 to end 96 of member 95 and to secure the hose enclosure member around hose 18. Loop material is provided on the inside of the protective hood in the regions 124, 125 and 126 as indicated by the dash line in FIG. 2 and hook material is provided on the outside of the protective hood in the regions 128, 129 and 130. Grip straps 132, 133 and 134 are secured to the protective hood to aid in removal of the hood.

An elastic positioning band 139 is attached to the inside back of the hood in order to pull the rigid lens firmly into place upon the visor housing. In order to prevent possible slippage or riding up of the material in the back of the hood, a strip of loop material 136 is secured to the back of the helmet 12 which can be secured to a strip of hook material 137 secured to the inside of the protective hood members 48 and 50 by sewing.

In a device constructed, the joint at the edge of the lens member and all of the seams were covered with a rubber reinforcement tape secured with a nonpermeable rubber cement. The tape effectively seals all holes created during the sewing operation.

An air flow is provided under the hood by cementing a nozzle member 140 to the underside and back portion of lens member 28. Air flow orifices 142 of different sizes are provided in the nozzle member 140 to provide the desired air flow distribution. The nozzle 140 directs the clean filtered air flow forward through the visor assembly and over the facial area under the lens 28. The air flow provides a positive pressure in the facial region as well as a flushing action to attain the necessary chemical-biological protection. Higher air flows may be provided to provide cooling and evaporative action in the facial region. A hose 146 is connected to the nozzle 140 and has the end 148 connected to a quick disconnect unit 147. A filtered air supply, not shown, is connected at 149 on the quick disconnect unit.

In the operation of the device, the protective hood 10 is placed over a helmet 12, with visor assembly 14 and oxygen mask 16 attached. The opening 120 in lens member 28 is aligned with the connector member 122 and the hood is pulled over the helmet with the lens 28 being positioned with the holes 123 aligned with the upper visor track screws. Hook material 137 is then pressed into engagement with loop material 136 to hold the hood in place. Pocket members 31 are then positioned so that the visor adjustments can be made through openings 30.

The hook material in regions 128 and 129 is then pressed into engagement with loop material in regions 124 and 125. The hook material in region 130 is then pressed into engagement with the loop material in region 126 to secure the hose enclosure member 24 around the hose 18. Hose 146 is then secured to a quick disconnect 147, located on the left parachute harness strap, which in turn, is connected to a filtered air supply.

For the removal of the protective hood the hooks in regions 128, 129 and 130 are disengaged from the loops in regions 128, 129 and 130 by gripping straps 132 and 133 and pulling in opposite directions. The protective hood can then be removed from the helmet by pulling back on strap 134.

The CB protective hood is modified as shown in FIGS. 5–8 to permit use with new technology ejection seats. The device of FIGS. 5–8 is made to reduce bulk and overcome possible parachute entanglement with the hood during ejection.

Figure 6:
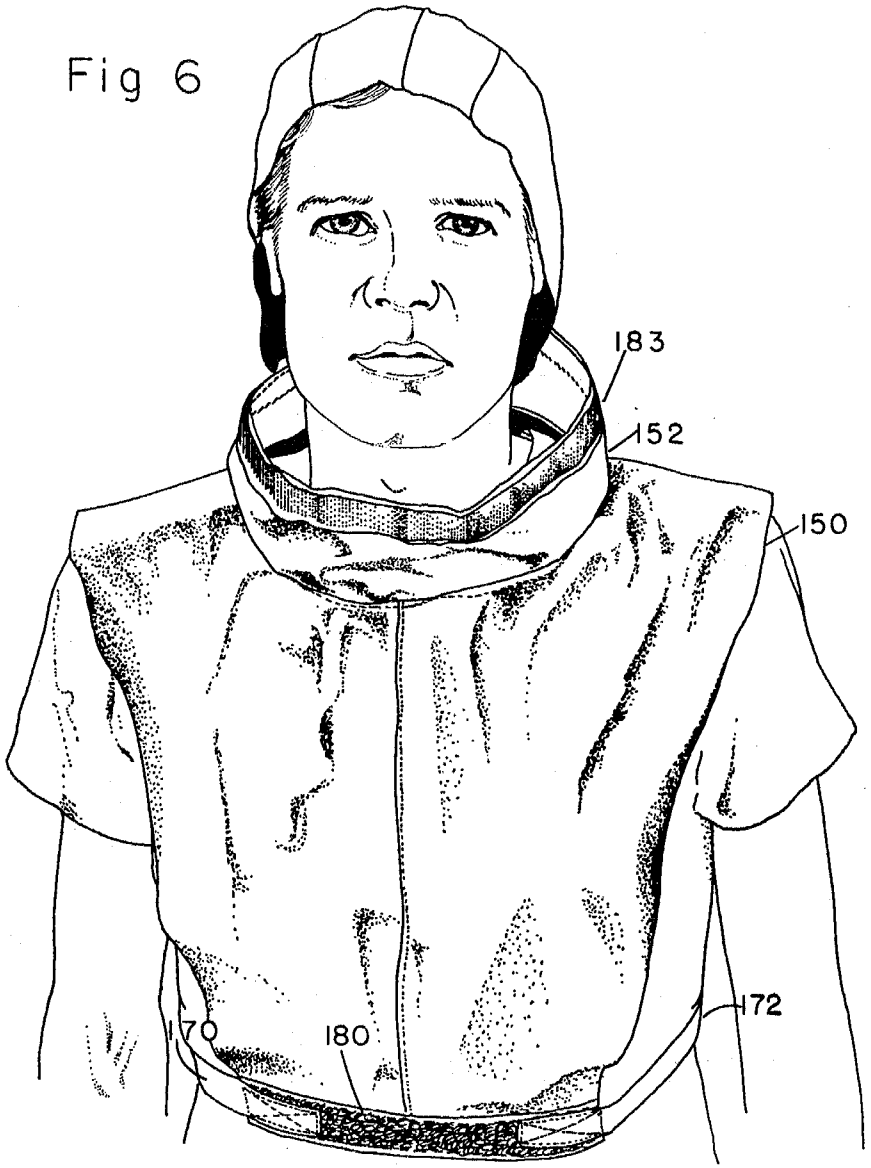
FIG. 6 is a partially schematic isometric view of a dickey for use with the device of FIG. 5.

The dickey 150, shown in FIG. 6, is worn under the flight suit and has a collar member 152, for engaging the protective hood 10'. The dickey includes two panel members 154 and 156, shown in FIG. 7, which are joined by sewing the member 154 to 156 along the edges 158 and 159 of member 154 and edges 161 and 162 of member 156. The collar member 152 is secured to dickey 150 by sewing member 164 to members 154 and 156 along edge 163 of member 164 and along edge 153 of member 154 and edge 155 of member 156. The ends of member 164 are joined by sewing along edges 166 and 167. Waist band members 170 and 172 are secured to members 154 and 156 by sewing ends 169 and 171 to members 154 and 156 at ends 174 and 175. The under side of ends 176 and 177 have hook fastener material secured thereto by sewing. Loop material is secured at 180 and 181 on members 154 and 156 to permit attachment of the ends of members 170 and 172. Hook fastener material is also secured to the top of collar member by sewing the material shown at 183, in FIG. 6.

The modified protective hood 10' includes a helmet covering member 22', a hose enclosure member 24' and rigid transparent lens 28', a neck member 185 and a short skirt member 187'. Openings 30 and pockets 31 are provided in the same manner as in the device of FIGS. 1–4.

Figure 8:
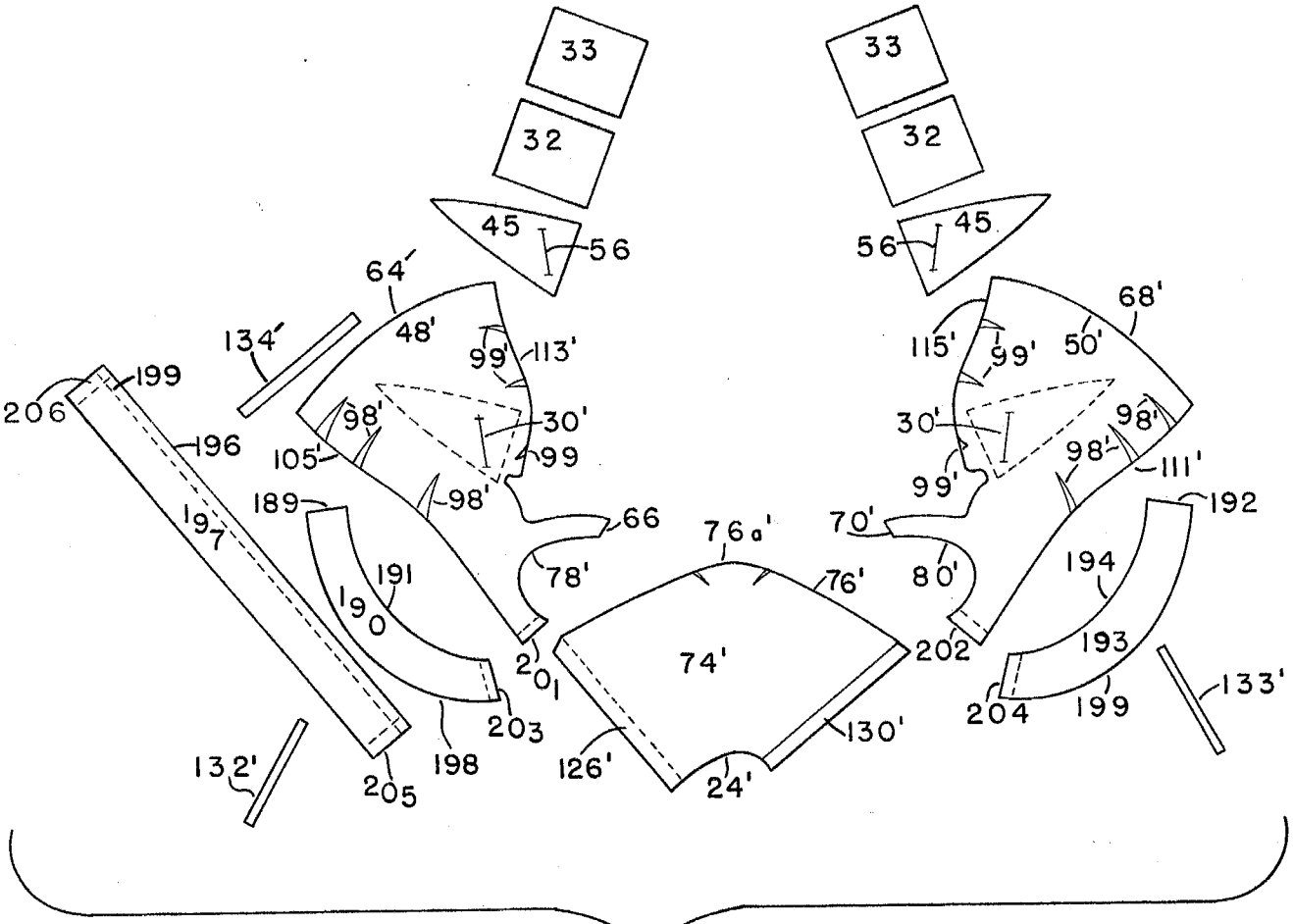
FIG. 8 is a plan view of the members used in the device of FIG. 5.

The helmet covering 22' is made by attaching member 48' to member 50', in FIG. 8, by sewing along edges 64' and 66' of member 48' and edges 68' and 70' of member 50'. The hose enclosure member 24' is secured to the helmet covering 22' as in the device of FIGS. 1–4. The neck band member is made by sewing member 190 to member 193 by sewing along edge 189 of member 190 and along edge 192 of member 193. The neck band member 185 is secured to the helmet covering 22' by sewing member 190 to member 48' along the edge 191 of member 190 and along edge 105' of member 48' and by sewing member 193 to member 50' along edge 194 of member 193 and along edge 111' of member 50'. The short skirt member 187 is secured to neck member 185 by sewing member 197 to member 190 and 193 along the edge 196 of member 197 and along the edges 198 of member 190 and along edge 199 of member 193. Loop material is provided on the inside of the protective hood in the region 126', 201, 203, and 205 of the protective hood and hook material is provided on the outside of the protective hood in regions 130', 202, 204 and 206. Loop material is also provided along the junction of members 185 and 187 on the inside of the hood to secure the hood member to hook material 183 on the collar of dickey 150. Grip straps 132', 133' and 134' are provided as in the device of FIGS. 1–4. Hook and loop material, the same as 136 and 137, not shown, is provided on the hood and helmet as in the device of FIGS. 1–4. The lens member 28' is secured to the edges 113' and 115' of members 48' and 50' as in the device of FIGS. 1–4. The air flow is provided as in the device of FIGS. 1–4. Whereas in the device of FIGS. 1–4 the hose 146 is merely brought out to the quick disconnect unit 147 beneath shoulder enclosure skirt, in the device of FIGS. 5–8 the hose can be brought out through an unengaged portion of the loop material on one of the members 185 or 187' and the hook material on collar member 152. The hose 146 could, however, be brought out through a rubber reinforced slit, not shown, in the member 50' on the neck band 185.

Figure 5:
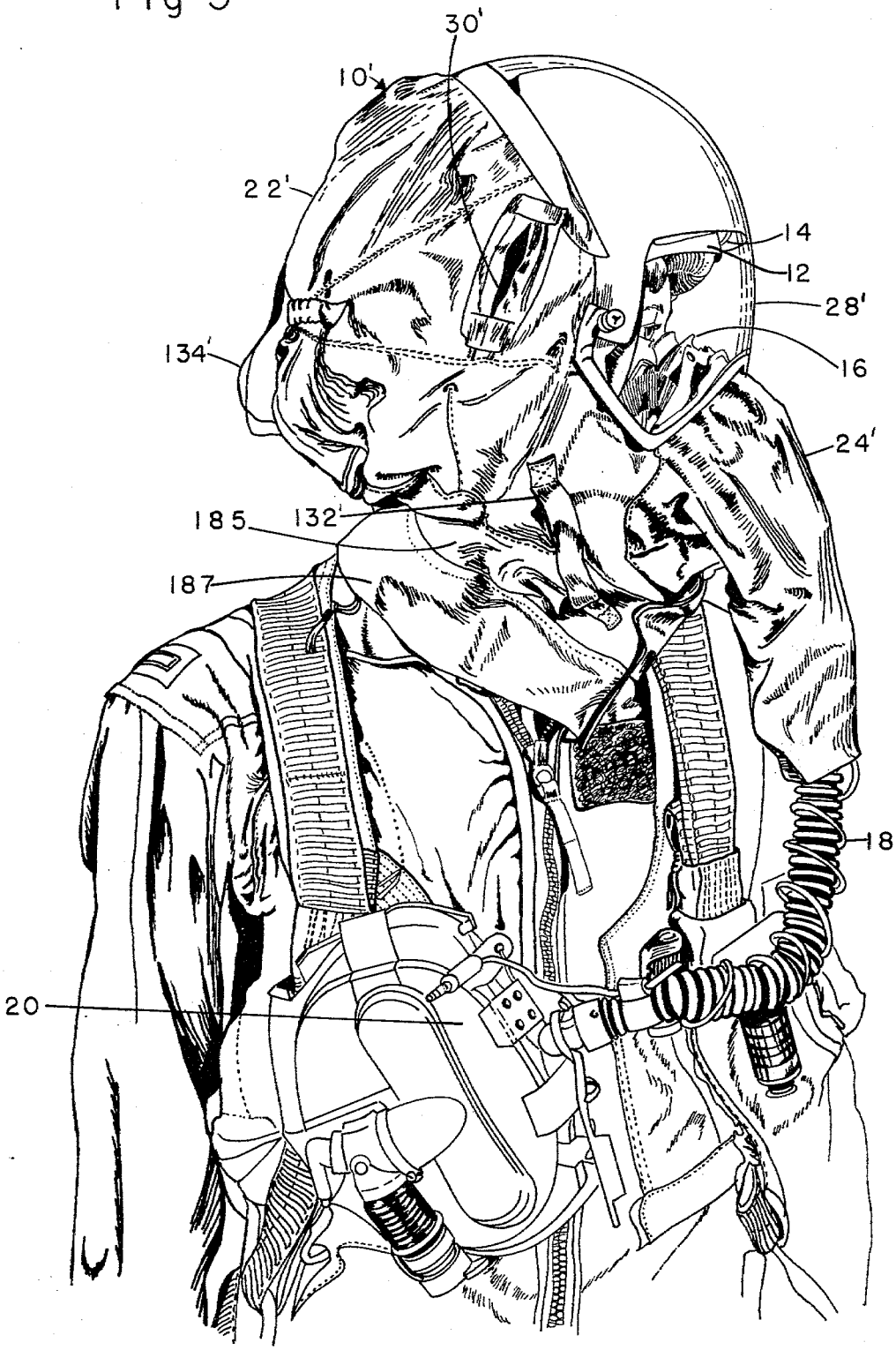
FIG. 5 is a partially schematic isometric view of a protective hood according to another embodiment of the invention.
Figure 7:
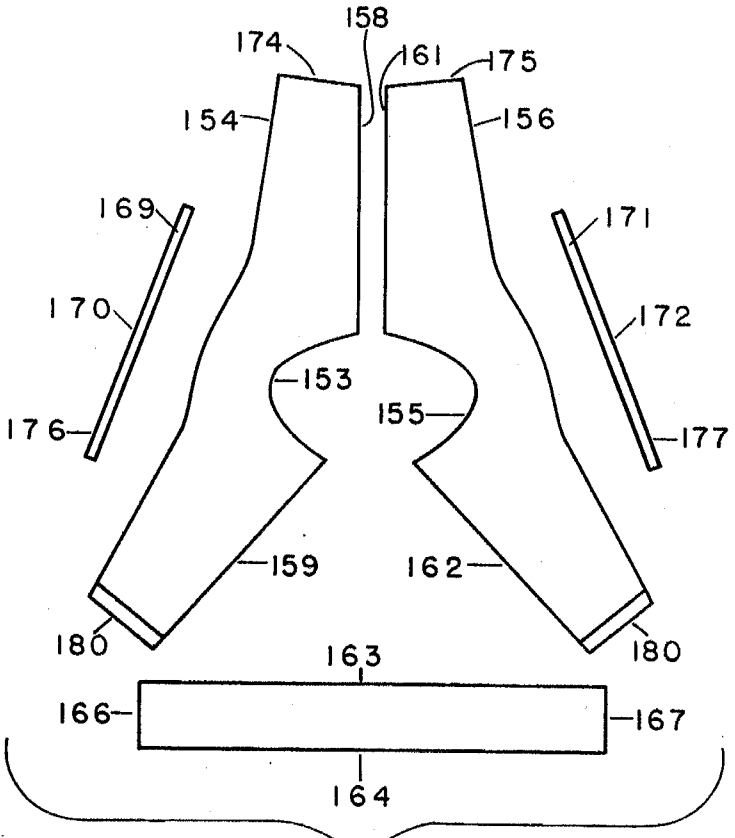
FIG. 7 is a plan view of the members used in the device of FIG. 6.

Some helmets do not include a flash blindness connector 122, for example as shown in FIG. 5. In this case no opening 120 is required in the lens member 28'. However where such a connector is not provided a goggle connector, similar to 122 could be cemented to the lens member 28.

The device of FIGS. 5–8 is used in substantially the same manner as the device of FIGS. 1–4 except that the dickey is worn under the flight suit and the hood member is secured to the collar member 152 by securing the loops in region 199 to the hook material at 183. In tests conducted the hood member was found to greatly improve the effectiveness over prior art protective equipment with no shifting under high g loads and with no crewman performance degradiation.

There is thus provided a protective hood to be worn with standard flight equipment, to provide chemical-biological agent protection.

I claim:

1. A protective hood for the protection of a flight crewmember from chemical-biological agent with the hood being positioned over a conventional flight helmet having a conventional visor assembly and oxygen mask attached and with an oxygen hose connected between the oxygen mask and a conventional chemical-biological agent filter with the hood having a portion partially covering the upper portion of the crewmember flight suit assembly, comprising: a helmet covering member; a hose enclosure member secured to said helmet covering member; a rigid transparent lens sealed to said helmet covering member and being adapted to fit over the visor assembly on said helmet and being spaced from said visor assembly and said oxygen mask; means, secured to the helmet covering member for covering the upper portion of the crewmember flight suit; said helmet covering, said hose enclosure member and said means for covering the upper portion of the crewmember flight suit being made of chemical-biological agent nonpermeable material; means including flow director means secured to the rear portion of the rigid transparent lens for blowing air inside the protective hood; fastener means, on the front of said protective hood, for closing the hood around the helmet and the upper portion of the flight suit; fastener means, on said hose enclosure member, for closing the hose enclosure member around the oxygen hose and means for positioning the protective hood on said flight helmet.

2. The device as recited in claim 1 including a pair of slots in the helmet covering member adjacent the sides of the visor assembly; a pair of pocket members positioned internally of the helmet covering member and covering said slots; said pocket members being made of chemical-biological-agent nonpermeable material; said means for positioning the protective hood on the flight helmet including an elastic band on said helmet covering member for holding the rigid lens firmly in place on the visor assembly and a section of loop material secured to the back of the flight helmet and a section of hook material on the inner side of the back of the helmet covering member for engaging the loop material on the flight helmet.

3. The device as recited in claim 2 wherein said means for covering the upper portion of the crewmember flight suit includes a shoulder enclosing skirt member.

4. The device as recited in claim 3 wherein said fastener means includes hook material along one edge of the helmet covering member, the shoulder enclosure member and the hose enclosure member and loop material along the opposite edge of the helmet covering member, the shoulder enclosure member and the hose enclosure member.

5. The device as recited in claim 2 including a dickey of chemical-biological-agent impermeable material, adapted to be positioned under the crewmember flight suit; said dickey including a collar member; said means for covering the upper portion of the crewman flight suit including a neck member secured to said helmet covering member and a short skirt member, adapted to fit around the collar portion of the flight suit; said short skirt member being secured to said neck member; means, secured to the upper portion of said dickey collar and the inner portion of said neck member adjacent the short skirt member for securing the neck member to said dickey collar.

6. The device as recited in claim 5 wherein said fastener means includes hook material along one edge of the helmet covering member, the neck member, the short skirt member and the hose enclosure member and loop material along the opposite edge of the helmet covering member, the neck member, the short skirt member and the hose enclosure member; said means, for securing the neck member to said dickey collar includes hook material secured to the top of said collar and loop material secured to the neck member adjacent the short skirt member.

* * * * *